United States Patent [19]

Dyett et al.

[11] 4,290,518

[45] Sep. 22, 1981

[54] FILTER ATTACHMENT MACHINES

[75] Inventors: Derek H. Dyett; Ivan Y. Hirsh; Edward G. Preston; Robert E. Williams, all of London, England

[73] Assignee: Molins Limited, London, England

[21] Appl. No.: 63,447

[22] Filed: Aug. 3, 1979

[30] Foreign Application Priority Data

Aug. 3, 1978 [GB] United Kingdom ..... 32143/78

[51] Int. Cl.[3] ..... B65G 29/00; B65G 47/68

[52] U.S. Cl. ..... 198/450; 83/102; 83/110; 83/411 R; 198/452

[58] Field of Search ..... 198/450, 452, 480, 481, 198/448, 608; 83/102, 107, 411 R, 110, 152, 154, 161

[56] References Cited

U.S. PATENT DOCUMENTS 3,405,579 10/1968 London ..... 198/450 X

FOREIGN PATENT DOCUMENTS 1122251 9/1956 France ..... 198/450

1014213 12/1965 United Kingdom ..... 198/481

*Primary Examiner*—Robert B. Reeves

*Assistant Examiner*—Douglas D. Watts

*Attorney, Agent, or Firm*—Craig and Antonelli

[57] ABSTRACT

A device for staggering and aligning filter portions cut from multiple-length filter rods includes a first fluted drum which conveys the filter rods (already cut) to a second fluted drum with a rolling plate for rolling at least one portion of each filter rod into a staggered position with respect to another portion of the same rod, at least one stationary finger being arranged to hold adjacent filter portions out of the flutes until they have been rolled to their staggered positions at least some of the filter portions along the flutes of the second drum are then displaced to align all the filter portions.

10 Claims, 4 Drawing Figures

Fig. 1
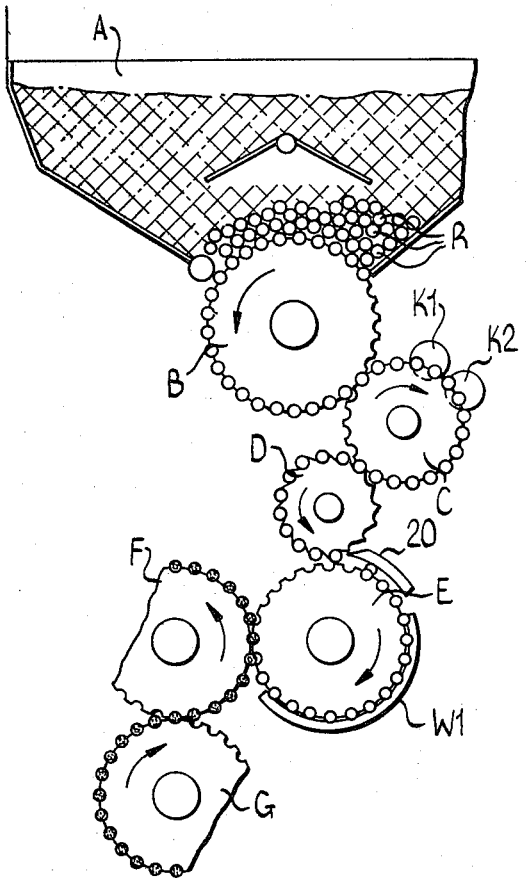
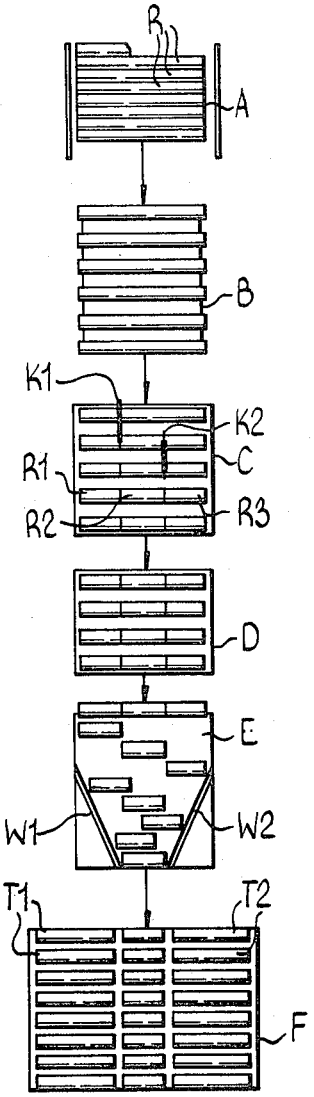
Fig. 2

FILTER ATTACHMENT MACHINES

In the manufacture of filter-tipped cigarettes it is common for the filter attachment machine to receive multiple-length filter rods, e.g. six times the length of each individual filter portion, which are cut into double-length portions each of which is joined between two tobacco rods before being cut through the middle. For this purpose, the filter rods are cut into double-length portions which are then staggered before being brought into alignment to form a single row of double-length portions. One way of staggering and aligning these portions is described in our U.S. Pat. No. 3,405,579. The present invention is concerned with a different arrangement.

According to the present invention, a device for staggering and aligning filter portions cut from multiple-length filter rods comprises a first fluted drum which conveys the filter rods (already cut) to a second fluted drum having adjacent to it a rolling plate for rolling at least one portion of each filter rod into a staggered position with respect to another portion of the same rod, at least one stationary finger extending into a circumferential recess in the second fluted drum to hold adjacent filter portions out of the flutes until they have been rolled into staggered positions by the rolling plate, and means for displaacing at least some of the staggered filter portions along the flutes of the second fluted drum to bring all the filter portions into alignment.

Compared with the arrangement shown in our U.S. Pat. No. 3,405,579, the present invention has the advantage that the filter portions are rolled into staggered positions and then aligned on the same drum. In the previous arrangement it was necessary to include a separate drum for aligning the filter portions, the need for that additional drum being avoided by the present invention.

An example of an apparatus according to this invention is shown in the accompanying drawings. In these drawings:

FIG. 1 is a diagrammatic front view of part of a filter attachment machine including the drum for staggering and aligning the filter portions;

FIG. 2 is a diagrammatic side view (in a flat-developed form) of the machine shown in FIG. 1;

FIG. 1 shows a hopper A which receives multiple-length ("six-up") filter rods R. A fluted drum B conveys rods R from the hopper and then transfers the rods to a fluted drum C on which the rods are cut by knives K1 and K2 into three equal portions, each portion being being a double-length portion. The cut rods are then received by a fluted drum D. Up to this point, the machine is similar to the Molins PA8 filter attachment machine.

The drums B, C and D all rotate relatively slowly, with a similar peripheral velocity. The next drum E rotates much faster in order to stagger the filter portions with a rolling operation as described below. The staggered filter portions, after being aligned by plough walls W1 and W2, are transferred to a further fluted drum F which also receives axially spaced pairs of tobacco rods T1 and T2 from a fluted drum G. Each assembly comprising two tobacco rods with an interposed double-length filter portion is subsequently secured by a uniting band, e.g. in the manner employed in the Molins PA8, after which the assemblies are cut through the middle to form individual filter-tipped cigarettes.

Figure 3:
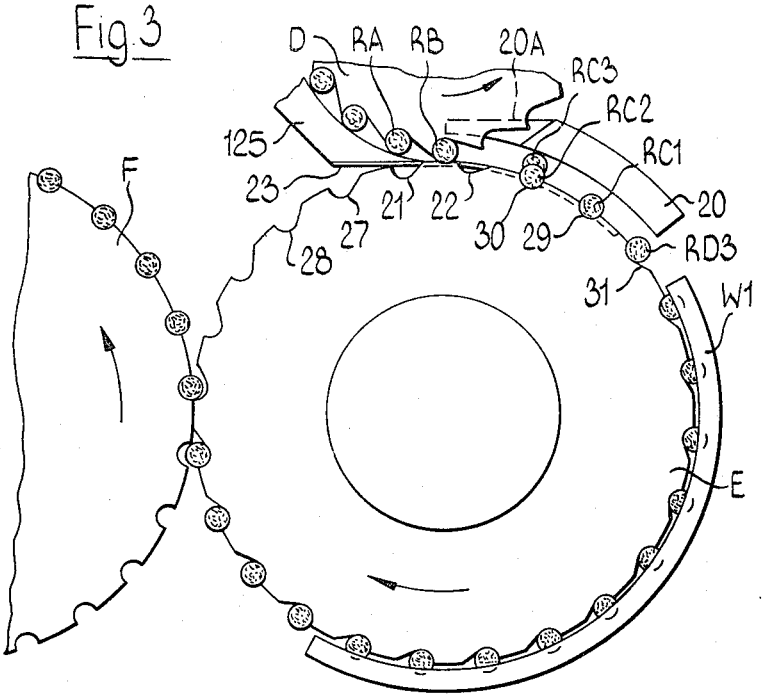
FIG. 3 is an enlarged view mainly of the drum on which the filter portions are staggered and aligned.
Figure 4:
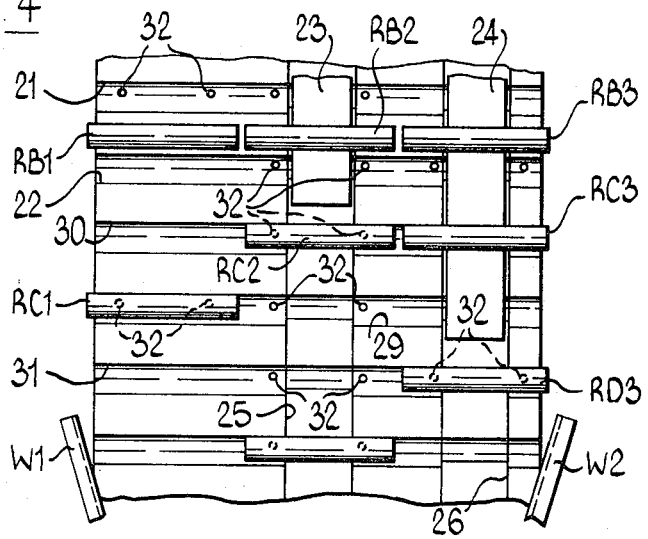
FIG. 4 is a flat-developed view of part of the surface of the drum shown in FIG. 3.

FIGS. 3 and 4 show how the portions of the filter rods R are staggered and then aligned.

FIG. 3 shows one filter rod RA (already cut) approaching the transfer point between the drums D and E, and a rod RB at the transfer point. Three fingers 20A extending from a rolling plate 20 help to strip the rods from the drum D and begin to roll the rods over the surface of the drum E. The timing of the two drums is such that all three portions of each filter rod roll between the plate 20 (or fingers 20A) and the drum E, at least for a short distance. For that purpose, the rod RB at the transfer point lies approximately midway between flutes 21 and 22 of the drum E; very shortly afterwards, a portion RB1 of the rod RB will drop into the flute 21.

The flutes in the drum E all extend along the complete length of the drum.

Portions RB2 and RB3 of the rod RB will be held out of the flute 21 by fingers 23 and 24 secured to a guide member 125 which helps to retain the filter rods in the flutes of the drum D until the transfer point. These fingers 23 and 24 extend into circumferential grooves 25 and 26 in the drum E, and their outer surfaces lie slightly below the outer surface of the drum E. The finger 23 extends only far enough to keep filter portion RB2 from dropping into flute 21, but permits portion RB2 to drop into the next flute 27 (see FIG. 3). The finger 24 extends further around the drum E so as to prevent filter portion RB3 from dropping into flute 21 or flute 27, but permits it to drop into the next flute 28.

Portions RC1 and RC2 of the preceding filter rod have already dropped respectively into flutes 29 and 30 while, at the stage shown, portion RC3 is being held by finger 24 from dropping into flute 30. Portion RC3 will shortly afterwards drop into flute 22 so that the three portions RC1, RC2 and RC3 of the filter rod RC will form an evenly staggered arrangement.

FIG. 4 also shows the trailing portion RD3 of the preceding filter rod RD. This portion has dropped into flute 31 and is about to be engaged by an inclined plough wall W2 which will push it towards the center of the drum E, into a position in alignment with the filter portions RC2, RB2 etc. Similarly, an inclined plough wall W1 is arranged to push filter portions RC1, RB1 etc., to the center of the drum and into alignment with the other filter portions.

The drum E has suction ports 32 to hold the filter portions in the flutes once they have dropped into the flutes. While they are being pushed towards the center of the drum by the walls W1 and W2, the outer portions of the filters may be retained by fixed guide walls (not shown), and suction through the adjacent ports may be discontinued so as not to produce frictional resistance against movement of the filter portions under the action of the walls W1 and W2.

While they are being rolled between the rolling plate 20 and the surface of the drum E, the filter portions may be perforated by pins on the plate and/or the surface of the drum, in areas near the ends of the filter portions, to produce ventilated cigarettes. The uniting band material would, in that case, be air-pervious in the region of the perforations. For that purpose, in order to treat all the filter portions similarly, a third finger similar to the fingers 23 and 24 would be included to hold the filter portions RA1, RB1 etc., out of the flutes of the drum for a predetermined period while they are being rolled and perforated. To allow sufficient time for a number of revolutions of the filter portions to occur during the perforation operation, the fingers 23 and 24 (and also the additional finger) would extend further than is shown in FIG. 4.

On rolling to a position adjacent to a flute which is covered by one of the fingers 23 and 24, it is expected that a filter portion (e.g. RB2 and RB3 as shown in FIG. 4) will momentarily stop. In order to ensure that rolling restarts during further rotation of the drum E, each rolling surface of the drum E may have a rough, high-friction surface and/or a projection or pin (or pins) adjacent to each flute to engage the rod portion in order positively to restart the rolling motion.

The walls W1 and W2 may be replaced by other means (e.g. air jets) for pushing the filter portions into aligned positions.

The order in which the portions of each filter rod drop into flutes in the drum E may be different. For example, portions 1 and 3 of each rod may be arranged to drop in first, so that their displacement to the centre of the drum can be started before the portion 2 has dropped into its corresponding flute.

We claim:

1. A device for use in a filter attachment machine for staggering and aligning filter portions cut from multiple-length filter rods, comprising a first fluted drum which conveys the cut filter rods to a second fluted drum having adjacent to it means including a rolling plate for rolling at least one portion of each filter rod into a staggered position with respect to another portion of the same rod and at least one stationary finger extending into a circumferential recess in the second fluted drum to hold adjacent filter portions out of the flutes until they have been rolled into staggered positions by the rolling plate, and means for displacing at least some of the staggered filter portions along the flutes of the second fluted drum to bring all the filter portions into alignment.

2. A device according to claim 1 in which the means for displacing at least some of the filter portions comprises at least one inclined wall acting as a plough for displacing the filter portions.

3. A device according to claim 1 or claim 2 in which the means for displacing at least some of the filter portions is arranged to act on at least one portion of each rod which enters the respective flute before another portion of the rod enters its respective flute.

4. A device according to claims 1, 2 or 3 in which the surfaces of the second drum which cooperate with the rolling plate to roll the filters have means for positively engaging the filter portions to promote the rolling motion.

5. A device according to claims 1, 2 or 3 in which the finger is mounted on a guide member which extends around the first drum and retains the filter rods on the first drum until they are transferred to the second drum.

6. Apparatus for feeding successive groups of axially-aligned, rod-like articles transversely of their axes and for repositioning the articles into staggered formation such that all of the articles are out of axial alignment with each other whereby subsequent axial movement of at least some of them will arrange all of the articles in a single row one behind another considered in the direction of feed, said apparatus comprising a repositioning conveyor in the form of a fluted drum having flutes extending along the length of the drum, means for continuously driving said fluted drum, means for feeding successive groups of axially-aligned articles to said fluted drum, retarding means adjacent said fluted drum to engage the articles received thereon so as to retard the movement of each article relatively to that of the said fluted drum until the article engages within a flute on the drum, means including at least one stationary finger extending into a circumferential recess in said fluted drum at the point articles are received from said feed means to hold adjacent articles out of the flutes until they have been moved into staggered positions by said retarding means, and means for axially displacing at least some of said staggered articles along the flutes of said fluted drum to bring all of the articles into alignment with each other in the direction of feed.

7. Apparatus as claimed in claim 6, wherein said retarding means comprises a rolling plate for rolling the articles of each successive group of articles into staggered positions with respect to one another in cooperation with the movement of said fluted drum.

8. Apparatus as claimed in claim 7, in which said displacing means comprises at least one inclined wall acting as a plough for displacing the articles within the flutes of the fluted drum.

9. Apparatus comprising means for feeding successive groups of axially-aligned rod-like articles transversely of their axes; a fluted drum having flutes extending across substantially the entire length thereof, said fluted drum being positioned adjacent said feeding means so as to receive said successive groups of axially-aligned rod-like articles therefrom and having $(n-1)$ circumferential grooves therein, wherein n is equal to the number of axially-aligned rod-like articles in each group received from said feeding means; means including a rolling plate for rolling at least $(n-1)$ articles of each group into a staggered position with respect to all of the other articles of the group; a plurality of stationary fingers each having a different length and each extending into a respective one of said circumferential grooves to hold adjacent articles out of the flutes until they have been rolled into staggered positions by said rolling plate; and means for bringing the staggered articles on said fluted drum into alignment in the direction of movement thereof so as to be arranged on said fluted drum in a single row one behind another in the direction of feed.

10. Apparatus according to claim 9, wherein the flutes on said drum are spaced to provide a rolling surface, and further including means for guiding said groups of articles from said feeding means to said rolling surfaces on said fluted drum.

* * * * *